US009708723B2

(12) United States Patent
Miura et al.

(10) Patent No.: US 9,708,723 B2
(45) Date of Patent: Jul. 18, 2017

(54) ELECTROPLATING CELL, AND METAL COATING AND METHOD OF FORMING THE SAME

(71) Applicant: TOYOTA JIDOSHA KABUSHIKI KAISHA, Toyota-shi, Aichi-ken (JP)

(72) Inventors: Fusayoshi Miura, Nagakute (JP); Atsushi Murase, Nagakute (JP); Naoki Hasegawa, Nagakute (JP); Motoki Hiraoka, Toyota (JP); Yuki Sato, Nagakute (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 79 days.

(21) Appl. No.: 14/613,629

(22) Filed: Feb. 4, 2015

(65) Prior Publication Data

US 2015/0218723 A1 Aug. 6, 2015

(30) Foreign Application Priority Data

Feb. 4, 2014 (JP) ..... 2014-019018

(51) Int. Cl.

| | |
|---|---|
| ***C25D 17/00*** | (2006.01) |
| ***C25D 21/14*** | (2006.01) |
| ***C25D 3/12*** | (2006.01) |
| ***C25D 5/06*** | (2006.01) |

(52) U.S. Cl.

CPC ..... *C25D 17/002* (2013.01); *C25D 3/12* (2013.01); *C25D 5/06* (2013.01); *C25D 21/14* (2013.01); *Y10T 428/12875* (2015.01)

(58) Field of Classification Search

None

See application file for complete search history.

(56) References Cited

U.S. PATENT DOCUMENTS

| | | | | |
|---|---|---|---|---|
| 807,973 | A | 12/1905 | Steenlet | |
| 2005/0016857 | A1* | 1/2005 | Kovarsky | C25D 21/18 205/98 |
| 2005/0189231 | A1 | 9/2005 | Capper et al. | |
| 2006/0096867 | A1* | 5/2006 | Bokisa | C25D 3/56 205/253 |
| 2008/0029402 | A1 | 2/2008 | Kurokawa et al. | |
| 2009/0277867 | A1 | 11/2009 | Mayer et al. | |
| 2015/0014178 | A1 | 1/2015 | Hiraoka et al. | |
| 2015/0122658 | A1* | 5/2015 | Kim | C25D 17/002 205/80 |

FOREIGN PATENT DOCUMENTS

| | | | |
|---|---|---|---|
| JP | 2000219993 | A | 8/2000 |
| JP | 2005-248319 | A | 9/2005 |
| JP | 2006199994 | A | 8/2006 |
| JP | 2006265632 | A | 10/2006 |
| JP | 2007-002274 | A | 1/2007 |

(Continued)

*Primary Examiner* — Harry D Wilkins, III

(74) *Attorney, Agent, or Firm* — Sughrue Mion, PLLC

(57) ABSTRACT

An electroplating cell includes: (i) an anode chamber in which an anode chamber solution is stored; and (ii) a separator that includes a base material and an organic plating additive contained in the base material, separates the anode chamber and a cathode from each other, and selectively allows permeation of metal ions contained in the anode chamber solution.

9 Claims, 3 Drawing Sheets

(56) References Cited

FOREIGN PATENT DOCUMENTS

| | | | |
|---|---|---|---|
| JP | 2007-523996 | A | 8/2007 |
| JP | 2007525598 | A | 9/2007 |
| JP | 2008-038208 | A | 2/2008 |
| JP | 2009-173992 | A | 8/2009 |
| JP | 2012-219362 | A | 11/2012 |
| WO | 2005/007933 | A1 | 1/2005 |
| WO | 2012161989 | A1 | 11/2012 |
| WO | 2013/125643 | A1 | 8/2013 |

* cited by examiner

ELECTROPLATING CELL, AND METAL COATING AND METHOD OF FORMING THE SAME

INCORPORATION BY REFERENCE

The disclosure of Japanese Patent Application No. 2014-019018 filed on Feb. 4, 2014 including the specification, drawings and abstract is incorporated herein by reference in its entirety.

BACKGROUND OF THE INVENTION

1. Field of the Invention

The present invention relates to an electroplating cell, and a metal coating and a method of forming the same, and more specifically relates to an electroplating cell which is capable of easily forming a metal coating on a surface of a cathode (plated object), a metal coating which is formed using the electroplating cell, and a method of forming the metal coating.

2. Description of Related Art

A technique of forming a pattern formed of a metal coating (hereinafter, referred to as "metal pattern") on a conductive substrate with a simple method is required. A technique of masking a portion other than a metal pattern to perform wet electroplating is most commonly used. However, in this technique, a mask forming step and a mask removing step are required, and there is a problem in that the cost for the management and waste liquid treatment of a plating solution is high. Recently, a method of forming a metal coating with a "physical method" such as physical vapor deposition or sputtering not having the above-described problem and then removing a masking portion has been adopted. However, in this method of physically forming a metal coating, a film forming speed is generally slow, and a vacuum unit is necessary. Therefore, it is difficult to say that a system using this method is an economical high-speed production system.

On the other hand, as another method in which masking is not necessary, a method of coating a substrate with an ink, in which conductive fine powder and a binder are mixed, using "printing method" such as screen printing or an ink jet and then removing the binder has been also adopted. However, with this "printing method", it is difficult to form a circuit having low volume resistivity even if a volatile or sublimable binder is used.

However, recently, as an attempt to form a circuit without masking in electroplating, a gel electrolyte (Japanese Patent Application Publication No. 2005-248319 (JP 2005-248319 A)) and a technique using a separator such as a solid electrolyte membrane (Japanese Patent Application Publication No. 2012-219362 (JP 2012-219362 A) and International Publication WO 2013/12563) have been proposed.

When such a separator is used, a current density of approximately 10 mA/cm$^2$ is obtained at room temperature in Cu plating in which electrodeposition from an aqueous solution is relatively easy. However, in a film forming process (high current density electrodeposition) in which a higher speed than that of the Cu plating is required, it is necessary to take an action, for example, to increase a metal ion concentration or to increase the temperature. Therefore, a higher cost is required. In particular, it is difficult to electrodeposit metal (for example, metal in which deposition potential of nickel ions, zinc ions, tin ions, or the like is low), in which an electrodeposition reaction (reduction deposition reaction) competes with a $H^+$ ion discharge reaction (hydrogen evolution reaction), from an acidic or slightly acidic aqueous solution having high $H^+$ concentration using a separator.

The details of the reason for this phenomenon is unclear, but it is considered that this phenomenon is caused by the following reasons (1) to (3).

(1) Hydrogen is produced at an electrodeposition portion, and defects (voids) are formed.

(2) Due to deposition over voltage being too low, metal is electroplated in a fine powder form or in a lump, and when the electrodeposition is performed in a state where a separator and a cathode are in close contact with each other, an electrodeposit infiltrates into the separator.

(3) Due to a pH increase caused by hydrogen production, a hydroxide is produced, and passivation (increase in bath voltage) progresses.

In order to solve the above-described problems, as in ordinary electroplating, a technique of adding, for example, an "organic plating additive" for improving physical properties of a deposited coating or suppressing hydrogen evolution reaction to a plating bath in which a separator is used is considered to be adopted. However, when the organic additive is added to the plating bath, it is necessary to accurately control the concentration of the organic additive. Further, since the organic additive is decomposed and consumed on an electrode, it is also necessary to remove a waste product. In addition, when a large amount of the organic additive is added to the plating bath, there is a problem in that electrodeposition efficiency is likely to decrease.

Furthermore, when the separator is an ion exchange membrane, and when the organic additive is an ionic compound, there is a problem in that the organic additive is adsorbed onto the separator, conductivity decreases, and bath voltage increases. For example, when metal ions in the plating bath are cations (positive ions), it is advantageous to use a solid electrolyte membrane (cation exchange membrane) having a high cation transport number as the separator from the viewpoint of high-speed plating. Nevertheless, in electroplating using a cation exchange membrane, it is common to adopt semi-bright plating not using an additive (Japanese Patent Application Publication No. 2009-173992 (JP 2009-173992 A)) or to use a non-ionic (neutral) separator having low risk of membrane fouling by the organic additive.

As the organic additive, it is recommended to use a non-ionic surfactant which is weak in coating physical property improving effect but is not likely to be adsorbed onto a cation exchange membrane (Japanese Patent Application Publication No. 2007-002274 (JP 2007-002274 A)) or to use a neutral additive (Published Japanese Translation of PCT application No. 2007-523996 (JP-A-2007-523996). Alternatively, it is recommended to laminate a neutral separator on a cathode chamber side of a cation exchange membrane and to add an organic additive to only a cathode chamber solution such that the organic additive is not adsorbed onto the cation exchange membrane (Japanese Patent Application Publication No. 2008-038208 (JP 2008-038208 A)). In the above-described techniques, an attempt to actively hold an organic plating additive inside a separator (in particular, a solid electrolyte membrane such as a cation exchange membrane) is not made.

SUMMARY OF THE INVENTION

The invention has been made to provide an electroplating cell which is capable of easily forming a metal coating; a metal coating which is formed using the electroplating cell; and a method of forming the metal coating.

Another object to be achieved by the invention is to provide an electroplating cell which is capable of electrodepositing a pattern on a base material surface with high speed using a plating solution containing metal ions in which hydrogen production is likely to occur; a metal coating which is formed using the electroplating cell; and a method of forming the metal coating.

Still another object to be achieved by the invention is to provide an electroplating cell which is capable of suppressing an increase in bath voltage caused by an additive contained in a plating solution being adsorbed onto a separator; a metal coating which is formed using the electroplating cell; and a method of forming the metal coating.

An electroplating cell according to the invention includes an anode chamber in which an anode chamber solution is stored and a separator that separates the anode chamber and a cathode from each other, in which an organic plating additive is added to a base material in the separator, and the separator can selectively allow permeation of metal ions contained in the anode chamber solution. The electroplating cell may further contain a cathode chamber in which a cathode chamber solution is stored.

According to a first aspect of the invention, there is provided an electroplating cell including: (i) an anode chamber in which an anode chamber solution is stored; and (ii) a separator that includes a base material and an organic plating additive contained in the base material, separates the anode chamber and a cathode from each other, and selectively allows permeation of metal ions contained in the anode chamber solution.

According to a second aspect of the invention, there is provided a method of forming a metal coating including: forming a metal coating on a surface of the cathode using the electroplating cell according to the first aspect of the invention. Further, according to a third aspect of the invention, there is provided a metal coating which is formed on a surface of the cathode using the method according to the second aspect of the invention.

When the organic plating additive for modifying the properties of the metal coating is added to the anode chamber solution, a relatively large amount of the additive is necessary. The addition of a large amount of the additive to the anode chamber solution causes a decrease in electrodeposition efficiency by the decomposition and consumption of the additive, or makes the concentration control complicated. On the other hand, when the organic plating additive is added to the separator, the additive is gradually moved from the separator to the cathode chamber solution, and a necessary amount thereof is replenished. Therefore, an excellent metal coating can be easily obtained. In addition, when electrodeposition is performed using the separator, the amount of the cathode chamber solution can be made to be zero or extremely small. Therefore, even when the addition amount of the additive to the separator is extremely small, the additive concentration on the cathode side is relatively high, and the properties of the coating are improved. Further, since only a minimum amount of the additive is fixed to the separator, the bath voltage does not increase.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Hereinafter, an embodiment of the invention will be described in detail.

[1. Electroplating Cell 10]

Figure 1:
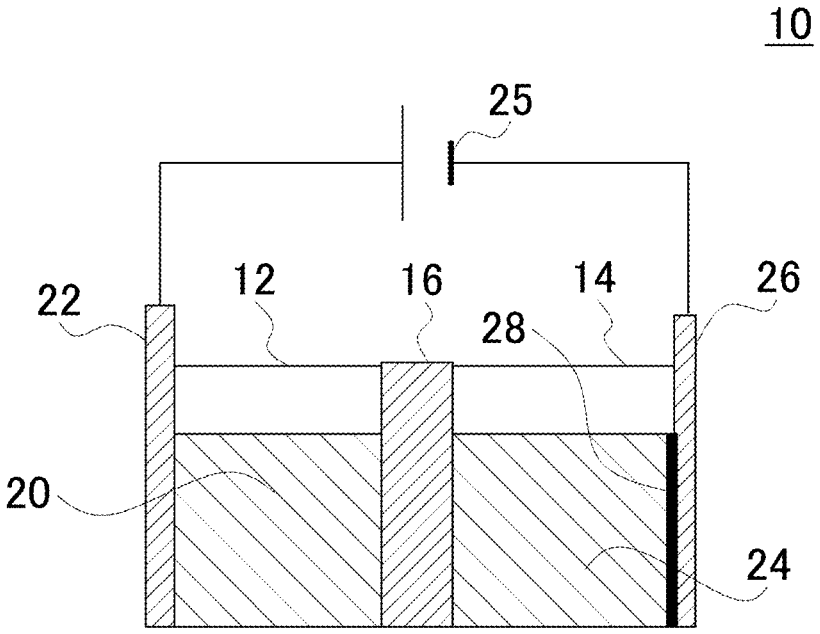
FIG. 1 is a schematic diagram illustrating an electroplating cell according to a first embodiment of the invention.

FIG. 1 is a schematic diagram illustrating an electroplating cell according to a first embodiment of the invention. In FIG. 1, an electroplating cell 10 includes an anode chamber 12, a cathode chamber 14, and a separator 16. The anode chamber 12 is filled with an anode chamber solution 20, and an anode 22 is dipped in the anode chamber solution 20. Further, the anode 22 is connected to a positive pole of a power supply 25. The cathode chamber 14 is filled with a cathode chamber solution 24, and a cathode 26 is dipped in the cathode chamber solution 24. Further, the cathode 26 is connected to a negative pole of the power supply 25. When plating is performed using this electroplating cell 10, a metal coating 28 is deposited on a surface of the cathode 26.

[1.1. Anode Chamber]

In the anode chamber 12, the anode chamber solution 20 is stored. The size and shape of the anode chamber 12, the material constituting the anode chamber 12, and the like are not particularly limited, and the optimum ones according to the purpose can be selected.

[1.2. Anode Chamber Solution]

The anode chamber 12 is filled with the anode chamber solution 20 having a predetermined composition. The details of the anode chamber solution 20 will be described below. The amount of the anode chamber solution 20 filling the anode chamber 12 is not particularly limited, and the optimum amount according to the purpose can be selected.

[1.3. Anode]

The anode 22 is not particularly limited as long as at least a surface thereof is formed of a conductive material. The entire portion or only a surface of the anode 22 may be formed of a conductive material. Further, the anode 22 may be an insoluble electrode or a soluble electrode.

Examples of the conductive material constituting the anode 22 include (1) metal oxides such as indium tin oxide (ITO), indium zinc oxide, indium oxide, tin oxide, iridium oxide, osmium oxide, ferrite, and platinum oxide; (2) non-oxides such as graphite and doped silicon; (3) metals such as copper, iron, nickel, beryllium, aluminum, zinc, indium, silver, gold, platinum, tin, zirconium, tantalum, titanium, lead, magnesium, and manganese; and (4) alloys containing two or more metals such as stainless steel.

As the conductive material constituting the anode 22 or the surface thereof, platinum, gold, iridium oxide, DSA (trade name: Dimension Stable Anode, manufactured by Permelec Electrode Ltd.), a ferrite electrode, or a graphite electrode is preferably used from the viewpoint of oxidation resistance. As the conductive material constituting the anode 22 or the surface thereof, platinum or indium oxide is more preferably used.

When a conductive thin film is formed on a surface of a base material of the anode 22, it is preferable that the thickness of the conductive thin film be selected to be optimum for the material thereof. For example, when the conductive thin film is formed of a metal oxide, the thickness thereof is preferably 0.1 μm to 5 μm and more preferably 0.5 μm to 1 μm. In addition, when the conductive thin film is formed of a metal or an alloy, the thickness thereof is preferably 5 μm to 1000 μm and more preferably 10 μm to 100 μm.

The size and shape of the anode 22 are not particularly limited, and the optimum ones according to the purpose can be selected. The anode 22 may be dense or porous. As described below, the electroplating cell 10 according to the embodiment of the invention can be used in a state where the cathode chamber solution 24 is not substantially present, that is, in a state where the separator 16 and the cathode 26 are in close contact with each other. In this case, when one having a predetermined pattern shape is used as the anode 22, and when electrodeposition is performed in a state where the anode 22 and the separator 16 are in close contact with each other, the shape of the anode 22 can be transferred to the cathode 26, that is, the metal coating 28 having the same shape as that of the pattern shape of the anode 22 can be formed. The metal pattern which can be formed according to the embodiment of the invention is not particularly limited as long as it has a shape in which a current can flow. Examples of the metal pattern include a mesh pattern, a rectangular pattern, a comb-shaped pattern, and various electric circuit patterns.

[1.4. Cathode Chamber]

In the cathode chamber 14, the cathode chamber solution 24 is stored. The size and shape of the cathode chamber 14, the material constituting the cathode chamber 14, and the like are not particularly limited, and the optimum ones according to the purpose can be selected. The cathode chamber 14 and the cathode chamber solution 24 are not essential and are not necessarily provided.

[1.5. Cathode Chamber Solution]

The cathode chamber 14 is filled with the cathode chamber solution 24 having a predetermined composition. The details of the cathode chamber solution 24 will be described below. The amount of the cathode chamber solution 24 filling the cathode chamber 14 is not particularly limited, and the optimum amount according to the purpose can be selected.

[1.6. Cathode]

The cathode 26 is a plated object. The cathode 26 is not particularly limited as long as at least a surface thereof is formed of a conductive material. The entire portion or only a surface of the cathode 26 may be formed of a conductive material.

Since specific examples of the conductive material constituting the cathode 26 are the same as those of the anode 22, the description thereof will not be repeated. In addition, when a conductive thin film is formed on a surface of a base material of the cathode 26, the preferable thickness of the conductive thin film is the same as in the description of the anode 22, and thus the description thereof will not be repeated. As the conductive material constituting the cathode 26 or the surface thereof, ITO, tin oxide, copper, or aluminum is preferably used, and ITO, tin oxide, or copper is more preferably used from the viewpoint of the material cost.

[1.7. Separator]

The separator 16 separates the cathode (plated object) 26 from the anode chamber 12. In the case of the electroplating cell 10 including the cathode chamber 14, the separator 16 is provided at a boundary between the anode chamber 12 and the cathode chamber 14. On the other hand, when the cathode chamber 14 is not present, the separator 16 is provided in contact with the surface of the cathode 26. In the embodiment of the invention, the separator 16 includes a base material and an organic plating additive which is added to the base material. In addition, in a state where a predetermined amount of the organic plating additive is added thereto, the separator 16 can selectively allow permeation of metal ions contained in the anode chamber solution 20. This point is different from the related techniques. Here, "the separator 16 can selectively allow permeation of metal ions" refers to a state where, during application of an electric field, the metal ions contained in the separator 16 move in a direction from the anode chamber 12 to the cathode chamber 14, and ions which are present as counter ions cannot move. In addition to the organic plating additive, the separator 16 may further contain ions of metal constituting the metal coating 28.

[1.7.1. Base Material of Separator]

The requirements for the base material of the separator 16 are shown in, for example, the following (1) to (4).

(1) When a voltage is applied to the metal ions contained in the anode chamber solution 20, the base material can allow the metal ions to move from the anode chamber 12 to the cathode chamber 14 (or the surface of the cathode 26).

(2) The base material is non-electronically conductive (the metal coating is not deposited on the separator 16).

(3) The base material is stable in a plating bath (the base material is insoluble in the anode chamber solution 20 or the cathode chamber solution 24 and maintains a sufficient mechanical strength).

(4) When a soluble anode is used as the anode 22, the base material can prevent diffusion of fine particles (anode sludge) produced from the soluble anode to the cathode chamber 14 (can function as an anode bag).

Specific examples of the base material of the separator 16 which satisfies these requirements include (1) a microporous membrane with a continuous pore having a size (average pore size: 100 μm or less) that can selectively allow permeation of metal ions; and (2) a solid electrolyte membrane having ion permeability. As the base material of the separator 16, a cation exchange membrane is preferably used. The base material of the separator 16 may be an organic material or an inorganic material as long as it satisfies the above-described requirements. As described above, the separator 16 to which the organic additive is added functions as an anode bag. However, the separator 16 to which the organic additive is added and an ordinary neutral separator which functions as an anode bag may be laminated.

[A. Specific Example of Microporous Membrane]

Examples of the microporous membrane formed of an organic material include (1) a microporous membrane formed of an organic polymer such as cellulose, polyethylene, polypropylene, polyester, polyketone, polycarbonate, polyterpene, polyepoxy, polyacetal, polyamide, polyimide, polyglycolic acid, polylactic acid, or polyvinylidene chloride; and (2) a microporous membrane formed of a solid polymer electrolyte such as an acrylic resin, a carboxyl group-containing polyester resin, a carboxyl group-containing polyamide resin, a polyamic acid resin, a polyether sulfonic acid resin, or a polystyrene sulfonic acid resin.

Regarding the organic microporous membrane, an inner surface of a pore may be modified with a well-known method to add an ion exchange group such as a carboxylic acid group or an amino group to the inner surface of the pore. The organic microporous membrane may be formed of one organic material alone or two or more organic materials. In addition, the microporous membrane containing two or more organic materials may be a laminated membrane in which two or more resin membranes are bonded to each other, or may be a complex membrane in which two or more resins are polymer-alloyed.

Examples of the microporous membrane formed of an inorganic material include (1) an inorganic ceramic filter such as alumina, zirconia, silica; (2) a porous glass; and (3) an organic/inorganic hybrid membrane in which alumina, silica, or the like is dispersed in a porous membrane formed of a polyolefin such as polyethylene or polypropylene.

The pore size of the microporous membrane is necessarily a size that can selectively allow permeation of the metal ions. Examples of the microporous membrane suitable for the selective permeation of the metal ions include (1) an ultrafiltration membrane UF having a pore size of 0.001 μm to 0.01 μm; and (2) a microfiltration membrane MF having a pore size of 0.05 μm to 10 μm. A reverse osmosis membrane RO having a pore size of 0.002 μm or less is not suitable for the separator 16 due to its excessively high ion permeation inhibition ratio.

The microporous membrane may be either non-woven fabric or woven fabric, and may be formed of a nanofiber produced by electrospinning. In addition, the microporous membrane may be (1) a membrane obtained by melting an organic polymer and extruding and drawing the molten organic polymer; or (2) a membrane obtained by a "cast method" including the steps of dissolving an organic polymer in a solvent, coating a PET base material or the like with the solution, and volatilizing the solvent from the coating. Further, the microporous membrane may be an inorganic porous ceramic.

These microporous membranes may be optionally subjected to the following treatments: (1) a rubber elastic body may be bonded thereto to reinforce the mechanical strength; (2) a net-like porous body may be provided as a core to reinforce the mechanical strength; and (3) a pattern may be formed on an ion conductive portion by coating a part of a surface of the ion conductive portion with an insulating coating body.

[B. Specific Examples of Solid Electrolyte Membrane]

The base material of the separator 16 may be a solid electrolyte membrane. When the metal ions to be electrodeposited is a cation, and when a solid electrolyte membrane is used as the base material of the separator 16, it is preferable that the base material of the separator 16 be a cation exchange membrane having a cation exchange group (for example, a carboxyl group, a sulfonic acid group, or a phosphonic acid group). On the other hand, when the metal ions to be electrodeposited are anions (for example, oxyacid anions such as zincate ions or stannate ions, or a cyanide ion complex), and when a solid electrolyte membrane is used as the base material of the separator 16, it is preferable that the base material of the separator 16 be an anion exchange membrane having an anion exchange group (for example, a quaternary ammonium group).

Examples of a cation exchange resin include (1) a carboxyl group-containing resin such as a carboxyl group-containing acrylic resin, a carboxyl group-containing polyester resin, a carboxyl group-containing polyamide resin, a carboxyl group-containing polyamide resin, or a polyamic acid resin; (2) a sulfonic acid group-containing resin such as a perfluorosulfonic acid resin; and (3) a phosphonic acid group-containing resin.

From the viewpoints of heat resistance, chemical resistance, and mechanical strength, as the cation exchange membrane, a fluorinated cation exchange membrane is preferably used, and a perfluorosulfonic acid resin membrane is more preferably used. In addition, the above-described cation exchange resins may be used alone or in a combination of two or more kinds.

[C. Advantageous Effect of Solid Electrolyte Membrane]

Hereinafter, the reason why the solid electrolyte membrane is more preferable as the base material of the separator 16 will be described. This is because, in principle, when the solid electrolyte membrane is used, high-speed plating can be performed as compared to a case where a neutral separator is used.

A limiting current density $I_L$ (maximum electrodeposition speed) is expressed by equation (1) based on a diffusion constant D of the metal ions, a valence z, an electrodeposited ion concentration C, a diffusion thickness δ on an electrodeposited surface, and an electrodeposited ion transport number α ("Regarding limiting current density of Nickel Plating", Metal Surface Technique 1, Shigeo HOSHINO et al., vol. 23, No. 5, 1972, p. 263).

$$I_L = DzFC/(\delta(1-\alpha)) \quad (1)$$

It can be seen from equation (1) that, for high-speed plating, it is efficient to increase the electrodeposited ion transport number α to be as high as possible. In electroplating using the neutral separator (microporous membrane), the metal ion transport number α in the separator is around 0.5. On the other hand, the ion transport number is high in the solid electrolyte membrane, and α is approximately 1 in the cation exchange membrane. Therefore, it can be understood from equation (1) that a high limiting current density $I_L$ can be obtained.

[1.7.2. Organic Plating Additive]

[A. Summary of Organic Plating Additive]

"Organic plating additive" refers to an organic compound having a function of improving smoothness (brightness) of a deposited coating and a function of preventing production of pits (macroscopic defects). The organic plating additive may be an ionic compound or a non-ionic compound. In addition, the organic plating additive may be a water-soluble compound or a water-insoluble compound. Here, "ionic compound" refers to an ion binding compound such as an acid, a base, or a salt thereof (for example, sodium lauryl sulfate). "Non-ionic compound" refers to a covalent compound not having an electrical charge such as polyethylene glycol or polypropylene glycol. "Water-soluble" refers to the solubility to water at room temperature being higher than 1 g/L. "Water-insoluble" refers to the solubility to water at room temperature being 1 g/L or lower.

For example, in the case of nickel plating, specific examples of the organic plating additive include (1) a primary brightening agent which refines crystals of a plated coating to impart brightness (for example, benzenesulfonic acid or saccharine); (2) a secondary brightening agent having a function of smoothing a plated coating (for example, formaldehyde or butynediol); (3) a surfactant which reduces a surface tension of the plating bath to improve wettability and to prevent production of pits (for example, sodium lauryl sulfate); and (4) a complexing agent which strongly coordinates to deposited metal ions and prevents precipitation of a hydroxide (for example, an organic acid or aminocarboxylic acid).

Examples of other additives include thiourea, benzothiazole, sodium naphthalenesulfonate, boronic acid, propargyl alcohol, and coumarin. All these additives are organic additives (secondary brightening agents) which impart smoothness. In plating other than nickel plating, organic additives which are commonly used can be added to the separator 16 to be used.

In ordinary electroplating, the organic plating additive is added to the plating bath in an appropriate amount, and it is necessary to control the consumption thereof. However, the control of the consumption of the additive is usually troublesome. In the embodiment of the invention, a minimum amount of the additive is added to the separator 16. Therefore, when the cathode chamber solution 24 is present, the additive is gradually eluted from the separator 16, and thus the effects can be exhibited for a long period of time. In addition, when the cathode chamber solution 24 is not present, the additive which is fixed to the separator 16 exhibits a strong interaction with a deposited metal surface and can improve physical properties and smoothness of the deposited metal.

That is, the speed of the organic additive oxidized and decomposed at a counter electrode (anode 22) or the speed of the organic additive reduced and consumed at the plated object (cathode 26) can be extremely minimized. Accordingly, the control of the concentration of the organic additive is unnecessary. In addition, a decrease in electrodeposition efficiency caused when the organic additive is excessively added to the plating bath; a decrease in the flexibility of a coating caused when a product decomposed in an electrode is condensed in the plating bath; or a decrease in solderability does not occur.

As the organic plating additive, a water-soluble compound which is commonly used in electroplating is preferably used, but a water-insoluble compound may also be used. For example, saccharin is relatively water-insoluble but is well soluble in an organic solvent. Therefore, when saccharin is dissolved in an organic solvent and is added to the separator 16 by impregnation, the additive starts to be gradually dissolved in the cathode chamber 14. As a result, the brightening effect can be exhibited for a long period of time. This is the advantageous effect which cannot be obtained when saccharin sodium (Na salt) which is easily soluble in water is added to the bath. Particularly in nickel plating, it is preferable that the additive be an organic compound containing N or P such as saccharin. This is because such an organic compound has a high effect of improving smoothness and physical properties of a coating.

Examples of the organic compound containing N which is the additive for nickel plating include amine, ammonium, imidazolium, pyridinium, amide, aminocarboxylic acid, betaine, and salts (compounds) thereof. It is preferable that ammonium be a compound having quaternary ammonium as a cation portion. This is because the quaternary ammonium compound has a high effect of improving smoothness of a coating. Examples of the organic compound containing P which is the additive for nickel plating include a phosphonium compound.

These additives may be used alone or in a combination of two or more kinds. In addition, the additive decreases a surface tension of a plating solution and may be (1) hydrogen gas produced from the cathode 26; or (2) a material (so-called "surfactant") having a high effect of promoting the degassing of oxygen gas produced from the insoluble electrode (anode 22). When the cation exchange membrane is used as the separator 16, and when the surfactant is used as the additive, it is preferable that the surfactant be a cationic surfactant or an amphoteric surfactant. These surfactants are likely to be fixed to the cation exchange membrane due to its electrostatic interaction with an acid group of the cation exchange membrane. On the other hand, when the anion exchange membrane is used as the separator 16, and when the surfactant is used as the additive, it is preferable that the surfactant be an anionic surfactant or an amphoteric surfactant. It is more preferable that the cation exchange membrane be used as the separator 16 and that the cationic surfactant or the amphoteric surfactant be used as the additive.

[B. Specific Examples of Additive]

[B.1. Organic Compound Containing N]

[B.1.1. Quaternary Ammonium Compound]

Examples of quaternary ammonium fluoride include tetraethylammonium fluoride hydrate, tetrabutylammonium fluoride, tetraethylammonium fluoride trihydrofluoride, tetraethylammonium fluoride tetrahydrofluoride, and tetramethylammonium fluoride tetrahydrate.

Examples of quaternary ammonium chloride include acetylcholine chloride, benzyldimethyltetradecylammonium chloride hydrate, (3-acrylamidopropyl)trimethylammonium chloride, benzethonium chloride, benzoylcholine chloride, benzylcetyldimethylammonium chloride hydrate, benzyltriethylammonium chloride, benzyldimethylphenylammonium chloride, benzyltrimethylammonium chloride, benzyldimethylstearylammonium chloride hydrate, benzyltributylammonium chloride, N-benzylquinidinium chloride, benzyldodecyldimethylammonium chloride dihydrate, 1-butyl-1-methylpyrrolidinium chloride, DL-carnitine hydrochloride, chlorocholine chloride, choline chloride, carbamylcholine chloride, (3-chloro-2-hydroxypropyl)trimethylammonium chloride, lauroylcholine chloride hydrate, dodecyltrimethylammonium chloride, decyltrimethylammonium chloride, dimethyldistearylammonium chloride, diallyldimethylammonium chloride, hexadecyltrimethylammonium chloride, hexamethonium chloride dihydrate, tetrabutylammonium chloride, methacholine chloride, triethyl(2-methoxyethoxymethyl)ammonium chloride, triethylmethylammonium chloride, methacroylcholine chloride, β-methylcholine chloride, n-octyltrimethylammonium chloride, triethylphenylammonium chloride, trimethylphenylammonium chloride, phosphocholine chloride calcium salt tetrahydrate, phosphocholine chloride sodium salt hydrate, trimethylstearylammonium chloride, succinylcholine chloride dihydrate, stachydrine hydrochloride, tetrabutylammonium chloride, tetraethylammonium chloride, trioctylmethylammonium chloride, trimethyltetradecylammonium chloride, trimethyl[2,3-(dioleyloxy)propyl]ammonium chloride, methyltri-n-octylammonium chloride, tetraamylammonium chloride, tetrapropylammonium chloride, trimethyl[3-(triethoxysilyl)propyl]ammonium chloride, and tributylmethylammonium chloride.

Examples of quaternary ammonium bromide include acetylcholine bromide, benzoylcholine bromide, benzyltriethylammonium bromide, bromocholine bromide, benzyltributylammonium bromide, 1,1'-(butane-1,4-diyl)bis[4-aza-1-azoniabicyclo[2.2.2]octane]dibromide, benzyltrimethylammonium bromide, 1-butyl-1-methylpiperidinium bromide, benzyldodecyldimethylammonium bromide, choline bromide, ethylhexadecyldimethylammonium bromide, decamethonium bromide, decyltrimethylammonium bromide, dodecyltrimethylammonium bromide, dilauryldimethylammonium bromide, dimethyldioctadecylammonium bromide, dimethyldipalmitylammonium bromide, dimethyldimyristylammonium bromide, didecyldimethylammonium bromide, dimethyldioctylammonium bromide, hexadecyltrimethylammonium bromide, homatropine methyl bromide, hexamethonium bromide, hexyltrimethylammonium bromide, hexyldimethyloctylammonium bromide, tetrabutylammonium bromide, methacholine bromide, neostigmine bromide, n-octyltrimethylammonium bromide, trimethylphenylammonium bromide, trimethylstearylammonium bromide, tetraethylammonium bromide, tetramethylammonium bromide, trimethylvinylammonium bromide, tetrapropylammonium bromide, tetradecyltrimethylammonium bromide, 3-(trifluoromethyl)phenyltrimethylammonium bromide, tetra(decyl)ammonium bromide, tetraamylammonium bromide, tetrahexylammonium bromide, tetraheptylammonium bromide, tetra-n-octylammonium bromide, trimethylnonylammonium bromide, trimethylpropylammonium bromide, and valethamate bromide.

Examples of quaternary ammonium iodide include acetylcholine iodide, acetylthiocholine iodide, benzoylcholine iodide, benzoylthiocholine iodide, benzyltriethylammonium iodide, butylcholine iodide, butylthiocholine iodide, choline iodide, decamethonium iodide, 1,1-dimethyl-4-phenylpiperazinium iodide, dimethyldioctadecylammonium iodide, ethyltrimethylammonium iodide, ethyltripropylammonium iodide, triethylcholine iodide, trimethylphenylammonium iodide, tetrabutylammonium iodide, tetraethylammonium iodide, tetramethylammonium iodide, tetrapropylammonium iodide, tetrahexylammonium iodide, tetraamylammonium iodide, 3-(trifluoromethyl)phenyltrimethylammonium iodide, tetra-n-octylammonium iodide, tetraheptylammonium iodide, and trimethyl[2-[(trimethylsilyl)methyl]benzyl]ammonium iodide.

Examples of quaternary ammonium hydroxide include benzyltrimethylammonium hydroxide, benzyltriethylammonium hydroxide, choline, hexadecyltrimethylammonium hydroxide, tetraethylammonium hydroxide, tetrabutylammonium hydroxide, trimethylphenylammonium hydroxide, tetramethylammonium hydroxide, tetrapropylammonium hydroxide, 3-(trifluoromethyl)phenyltrimethylammonium hydroxide, tetrahexylammonium hydroxide, and tris(2-hydroxyethyl)methylammonium hydroxide.

Examples of other quaternary ammonium compounds include acetylcholine perchlorate, amyltriethylammonium bis(trifluoromethanesulfonyl)imide, anhydrous betaine, betaine hydrochloride, bis(tetrabutylammonium)dichromate, benzyltrimethylammonium tetrachloroiodate, benzyltrimethylammonium dichloroiodate, didecyldimethylammonium adipate, 1-butyl-1-methylpyrrolidinium bis(trifluoromethanesulfonyl)imide, benzyltriethylammonium borohydride, L-carnitine, choline bitartrate, 1-cyclohexyl-3-(2-morpholinoethyl)carbodiimide metho-p-toluenesulfonate, 3-[(3-cholamidopropyl)dimethylammonio]-1-propanesulfonate, cyclohexyltrimethylammonium bis(trifluoromethanesulfonyl)imide, L-carnitine-L-tartrate, denatonium benzoate, dodecyldimethyl(3-sulfopropyl)ammonium hydroxide inner salt, decyldimethyl(3-sulfopropyl)ammonium hydroxide inner salt, dimethyl(n-octyl)(3-sulfopropyl)ammonium hydroxide inner salt, N-fluoro-N'-(chloromethyl)triethylenediamine bis(tetrafluoroborate), hexadecyltrimethylammonium hexafluorophosphate, hexadecyltrimethylammonium tetrafluoroborate, hexadecyltrimethylammonium perchlorate, hexadecyldimethyl(3-sulfopropyl)ammonium hydroxide inner salt, (2-hydroxyethyl)dimethyl(3-sulfopropyl)ammonium hydroxide inner salt, tetrabutylammonium phosphate, tetrabutylammonium hydrogen sulfate, (methoxycarbonylsulfamoyl)triethylammonium hydroxide inner salt, methyltri-n-octylammonium hydrogen sulfate, methyltri-n-octylammonium bis(trifluoromethanesulfonyl)imide, 2-(methacryloyloxy)ethyl 2-(trimethylammonio)ethyl phosphate, 1-methyl-1-propylpyrrolidinium bis(trifluoromethanesulfonyl)imide, neostigmine methyl sulfate, octadecyldimethyl(3-sulfopropyl)ammonium hydroxide inner salt, propionylcholine p-toluenesulfonate, trimethylphenylammonium tribromide, scopolamine methyl nitrate, tetrabutylammonium perchlorate, tetraethylammonium borohydride, tetraethylammonium perchlorate, tetramethylammonium hydrogen sulfate, tetramethylammonium perchlorate, tetramethylammonium tetrafluoroborate, tetramethylammonium p-toluenesulfonate, tetramethylammonium borohydride, tetrabutylammonium tetrafluoroborate, tetrabutylammonium borohydride, tetrabutylammonium azide, tetraethylammonium p-toluenesulfonate, tetraethylammonium tetrafluoroborate, tetramethylammonium acetate, tetrabutylammonium dichlorobromide, tetrabutylammonium dibromochloride, tetrabutylammonium bromodiiodide, tetrabutylammonium triiodide, tetrabutylammonium salicylate, tetrabutylammonium thiocyanate, tetrabutylammonium hexafluorophosphate, tetrabutylammonium tribromide, tetrabutylammonium bifluoride, tetramethylammonium hexafluorophosphate, benzyltrimethylammonium tribromide, tetrabutylammonium tetraphenylborate, tetramethylammonium triacetoxyborohydride, tetrabutylammonium trifluoromethanesulfonate, tetrabutylammonium dihydrogen trifluoride, tetraethylammonium trifluoromethanesulfonate, tetrabutylammonium difluorotriphenylsilicate, triethylmethylammonium tetrafluoroborate, tetradecyldimethyl(3-sulfopropyl)ammonium hydroxide inner salt, tetrabutylammonium p-nitrophenoxide, and tetrabutylammonium acetate.

[B.1.2. Imidazolium Compound]

Examples of the imidazolium compound include 1-butyl-3-methylimidazolium bromide, 1-butyl-3-methylimidazolium chloride, 1-butyl-3-methylimidazolium tetrafluoroborate, 1-butyl-3-methylimidazolium hexafluorophosphate, 1-butyl-3-methylimidazolium trifluoromethanesulfonate, 1-butyl-2,3-dimethylimidazolium chloride, 1-butyl-2,3-dimethylimidazolium hexafluorophosphate, 1-butyl-2,3-dimethylimidazolium tetrafluoroborate, 1-butyl-3-methylimidazolium bis(trifluoromethanesulfonyl)imide, 1-butyl-3-methylimidazolium tetrachloroferrate, 1-butyl-3-methylimidazolium iodide, 1-butyl-2,3-dimethylimidazolium bis(trifluoromethanesulfonyl)imide, 1-butyl-3-methylimidazolium trifluoro(trifluoromethyl)borate, 1-butyl-3-methylimidazolium tribromide, 1,3-dimethylimidazolium dimethyl phosphate, 1,3-dimethylimidazolium chloride, 1,3-bis(2,6-diisopropylphenyl)imidazolinium chloride, 1,3-di(1-adamantyl)imidazolium tetrafluoroborate, 1,3-diisopropylimidazolium tetrafluoroborate, 1,3-di-tert-butylimidazolium tetrafluoroborate, 1,3-dicyclohexylimidazolium tetrafluoroborate, 1,3-dicyclohexylimidazolium chloride, 1,2-dimethyl-3-propylimidazolium iodide, 2,3-dimethyl-1-propylimidazolium bis(trifluoromethanesulfonyl)imide, 1-decyl-3-methylimidazolium bis(trifluoromethanesulfonyl)imide, 1-ethyl-3-methylimidazolium chloride, 1-ethyl-3-methylimidazolium hexafluorophosphate, 1-ethyl-3-methylimidazolium bromide, 1-ethyl-3-methylimidazolium iodide, 1-ethyl-3-methylimidazolium bis(trifluoromethanesulfonyl)imide, 1-ethyl-3-methylimidazolium ethyl sulfate, 1-ethyl-3-methylimidazolium p-toluenesulfonate, 1-ethyl-3-methylimidazolium 2-(2-methoxyethyl)ethyl sulfate, 1-ethyl-3-methylimidazolium tetrachloroferrate, 1-ethyl-2,3-dimethylimidazolium bis(trifluoromethanesulfonyl)imide, 1-ethyl-3-methylimidazolium hydrogen sulfate, 1-ethyl-3-methylimidazolium methanesulfonate, 1-ethyl-3-methylimidazolium trifluoro(trifluoromethyl)borate, 1-hexyl-3-methylimidazolium chloride, 1-hexyl-3-methylimidazolium hexafluorophosphate, 1-hexyl-3-methylimidazolium tetrafluoroborate, 1-hexyl-3-methylimidazolium bromide, 1-hexyl-3-methylimidazolium bis(trifluoromethanesulfonyl)imide, 1-methyl-3-propylimidazolium iodide, 1-methyl-3-n-octylimidazolium bromide, 1-methyl-3-n-octylimidazolium chloride, 1-methyl-3-n-octylimidazolium hexafluorophosphate, 1-methyl-3-[6-(methylsulfinyl)hexyl] imidazolium p-toluenesulfonate, and 1-methyl-3-[6-(methylthio)hexyl]imidazolium p-toluenesulfonate.

[B.1.3. Pyridinium Compound]

Examples of the pyridinium compound include 1-aminopyridinium iodide, 1-acetonylpyridinium chloride, 1-(carbamoylmethyl)pyridinium chloride, amprolium hydrochloride, 4-bromopyridine hydrochloride, 2-bromo-1-ethylpyridinium tetrafluoroborate, 4-bromopyridine hydrobromide, 1-butylpyridinium chloride, 1,1'-bis(2,4-dinitrophenyl)-4,4'-bipyridinium dichloride, 1-butylpyridinium bromide, 1-butylpyridinium hexafluorophosphate, 1,1'-[biphenyl-4,4'-diylbis(methylene)]bis(4,4'-bipyridinium)dibromide, bis(2,4,6-trimethylpyridine)bromonium hexafluorophosphate, 1-butyl-4-methylpyridinium bromide, 1-butyl-4-methylpyridinium hexafluorophosphate, 1-butyl-3-methylpyridinium bromide, 1-butylpyridinium tetrafluoroborate, 1-butyl-4-methylpyridinium chloride, 4-chloropyridine hydrochloride, 2-(chloromethyl)pyridine hydrochloride, 3-(chloromethyl)pyridine hydrochloride, 2-chloro-1-methylpyridinium iodide, 2-chloro-1-methylpyridinium p-toluenesulfonate, 4-carbamoyl-1-hexadecylpyridinium chloride, 1-dodecylpyridinium chloride, 1,1'-diheptyl-4,4'-bipyridinium dibromide, 2,6-dimethylpyridinium p-toluenesulfonate, 4-dimethylaminopyridinium bromide perbromide, 4-dimethylamino-1-neopentylpyridinium chloride, 1,1'-di-n-octyl-4,4'-bipyridinium dibromide, 2,6-dihydroxypyridine hydrochloride, 1,1'-dibenzyl-4,4'-bipyridinium dichloride hydrate, 1,1'-diphenyl-4,4'-bipyridinium dichloride, 1-(dimethylcarbamoyl)-4-(2-sulfoethyl)pyridinium hydroxide inner salt, 4-(dimethylamino)-1-(triphenylmethyl)pyridinium chloride, 1,1'-dimethyl-4,4'-bipyridinium dichloride, 1,1'-difluoro-2,2'-bipyridinium bis(tetrafluoroborate), 1-(2,4-dinitrophenyl)pyridinium chloride, 1-ethylpyridinium bromide, 1-ethyl-4-(methoxycarbonyl)pyridinium iodide, 1-ethylpyridinium chloride, 1-ethyl-3-methylpyridinium ethyl sulfate, 1-ethyl-3-(hydroxymethyl)pyridinium ethyl sulfate, 1-ethyl-3-methylpyridinium bis(trifluoromethanesulfonyl)imide, 2-fluoro-1-methylpyridinium p-toluenesulfonate, 1-fluoropyridinium trifluoromethanesulfonate, 1-fluoro-2,4,6-trimethylpyridinium trifluoromethanesulfonate, 2,6-dichloro-1-fluoropyridinium trifluoromethanesulfonate, 1-fluoropyridinium tetrafluoroborate, 1-fluoro-2,6-dichloropyridinium tetrafluoroborate, 1-fluoro-2,4,6-trimethylpyridinium tetrafluoroborate, 1-(hydrazinocarbonylmethyl)pyridinium chloride, hexadecylpyridinium chloride monohydrate, hexadecylpyridinium bromide hydrate, 1-hexadecyl-4-methylpyridinium chloride hydrate, isonicotinoyl chloride hydrochloride, 3-carbamyl-1-methylpyridinium chloride, 1-methylpyridinium-2-aldoxime chloride, 1-methylpyridinium chloride, N-phenylnicotinamide hydrochloride, pyridine-2-carboxylic acid hydrochloride, pyridoxamine dihydrochloride monohydrate, pyridoxine hydrochloride, 1-(4-pyridyl)pyridinium chloride hydrochloride hydrate, pyridine-2-carbonyl chloride hydrochloride, 3-pyridylacetic acid hydrochloride, 1-phenacylpyridinium bromide, pyridinium bromide perbromide, pyridinium chlorochromate, pyridinium dichromate, pyridinium 3-nitrobenzenesulfonate, pyridinium p-toluenesulfonate, 2-pyridylacetic acid, pyridinium fluorochromate, pyridostigmine bromide, 1-propylpyridinium chloride, pyridinium trifluoromethanesulfonate, pyridine hydrochloride, pyridine hydrobromide, 1-(3-sulfopropyl)pyridinium hydroxide inner salt, 2,4,6-trimethylpyridinium p-toluenesulfonate, trigonelline hydrochloride, and 1-(trifluoroacetyl)-4-(dimethylamino)pyridinium trifluoroacetate.

[B.1.4. Aminocarboxylic Acid Compound]

Examples of the aminocarboxylic acid compound include ethylimino-N,N-diacetic acid, glycine, iminodiacetic acid, hydroxyethyl-ethylenediamine triacetic acid, nitrilotriacetic acid, EDTA, triethylenediamine tetraacetic acid, glutaminic acid, aspartic acid, beta-alanine N,N-diacetic acid, and tricarbarylic acid.

[B.1.5. Amine Compound]

Examples of the amine compound include para toluene sulfonamide (saccharin) and polyoxyalkylene-added alkylamide.

[B.2. Compound Containing P]

[B2.1. Phosphonium Compound]

Examples of the phosphonium compound include amyltriphenylphosphonium bromide, allyltriphenylphosphonium bromide, allyltriphenylphosphonium chloride, acetonitriletriphenylphosphonium chloride, benzyltriphenylphosphonium chloride, butyltriphenylphosphonium bromide, (bromomethyl)triphenylphosphonium bromide, 3-bromopropyltriphenylphosphonium bromide, 1h-benzotriazol-1-yloxytris(dimethylamino)phosphonium hexafluorophosphate, 1h-benzotriazol-1-yloxytripyrrolidinophosphonium hexafluorophosphate, benzyltriphenylphosphonium bromide, trans-2-butene-1,4-bis(triphenylphosphonium chloride), bromotripyrrolidinophosphonium hexafluorophosphate, bromotris(dimethylamino)phosphonium hexafluorophosphate, (tert-butoxycarbonylmethyl)triphenylphosphonium bromide, (chloromethyl)triphenylphosphonium chloride, 4-(carboxybutyl)triphenylphosphonium bromide, cinnamyltriphenylphosphonium bromide, cyclopropyltriphenylphosphonium bromide, (4-chlorobenzyl)triphenylphosphonium chloride, (3-carboxypropyl)triphenylphosphonium bromide, (2-chlorobenzyl)triphenylphosphonium chloride, chlorotripyrrolidinophosphonium hexafluorophosphate, 2-dimethylaminoethyltriphenylphosphonium bromide, 2-(1,3-dioxan-2-yl) ethyltriphenylphosphonium bromide, 2-(1,3-dioxolan-2-yl) ethyltriphenylphosphonium bromide, (1,3-dioxolan-2-yl) methyltriphenylphosphonium bromide, (2,4-dichlorobenzyl)triphenylphosphonium chloride, tributyldodecylphosphonium bromide, di-tert-butylmethylphosphonium tetraphenylborate, (3,4-dimethoxybenzyl)triphenylphosphonium bromide, ethyltriphenylphosphonium bromide, ethoxycarbonylmethyl(triphenyl)phosphonium bromide, 4-ethoxybenzyltriphenylphosphonium bromide, ethyltriphenylphosphonium iodide, (formylmethyl)triphenylphosphonium chloride, hexyltriphenylphosphonium bromide, heptyltriphenylphosphonium bromide, tributylhexadecylphosphonium bromide, (2-hydroxybenzyl)triphenylphosphonium bromide, isopropyltriphenylphosphonium iodide, methyltriphenylphosphonium iodide, methyltriphenylphosphonium bromide, (methoxymethyl)triphenylphosphonium chloride, (N-methyl-N-phenylamino)triphenylphosphonium iodide, methoxycarbonylmethyl(triphenyl) phosphonium bromide, tributylmethylphosphonium iodide, (1-naphthylmethyl)triphenylphosphonium chloride, (4-nitrobenzyl)triphenylphosphonium bromide, tributyl-n-octylphosphonium bromide, phenacyltriphenylphosphonium bromide, triphenylpropylphosphonium bromide, triphenylpropagylphosphonium bromide, tetrakis(hydroxymethyl)phosphonium chloride, tetraphenylphosphonium bromide, tetraphenylphosphonium tetraphenylborate, tetraphenylphosphonium chloride, tetraethylphosphonium bromide, tetraphenylphosphonium iodide, 2-(trimethylsilyl) ethoxymethyltriphenylphosphonium chloride, (3-trimethylsilyl-2-propynyl)triphenylphosphonium bromide, triphenyl (tetradecyl)phosphonium bromide, (2-trimethylsilylethyl) triphenylphosphonium iodide, triphenylvinylphosphonium bromide, tetrabutylphosphonium chloride, tetra-n-octylphosphonium bromide, tetraethylphosphonium hexafluorophosphate, tetraethylphosphonium tetrafluoroborate, tetrabutylphosphonium benzotriazolate, tetrabutylphosphonium tetrafluoroborate, tetrabutylphosphonium hexafluorophosphate, tetrabutylphosphonium tetraphenylborate, tri-tert-butylphosphonium tetraphenylborate, tributyl(2-methoxyethyl)phosphonium bis(trifluoromethanesulfonyl)imide, tetrabutylphosphonium hydroxide, tri-tert-butylphosphonium tetrafluoroborate, tricyclohexylphosphonium tetrafluoroborate, tetraphenylphosphonium tetra-p-tolylborate, tributylmethylphosphonium bis(trifluoromethanesulfonyl) imide, and tributyl(1,3-dioxolan-2-ylmethyl)phosphonium bromide.

[B.3. Surfactant]

[B.3.1. Cationic Surfactant]

Examples of the cationic surfactant include alkyl amine salts (for example, products manufactured by Kao Corporation such as ACETAMIN 24 and ACETAMIN 86) and quaternary ammonium salts (for example, products manufactured by Kao Corporation such as QUARTAMIN 24P, QUARTAMIN 86P CONC, QUARTAMIN 60W, QUARTAMIN 86W, QUARTAMIN D86P, SANISOL C, and SANISOL CB-50; products manufactured by Sanyo Chemical Industries Ltd. such as OSMOLIN DA-50, CATION DDC-50, and CATION DDC-80; and products manufactured by NOF Corporation such as NISSAN CATION series). Examples of the fluorinated cationic surfactant include products manufactured by AGC Seimi Chemical Co., Ltd. such as SURFLON S-221 and S-121; products manufactured by 3M such as FLUORAD FC-134; and products manufactured by DIC Corporation such as MEGAFAC F-150.

[B.3.2. Amphoteric Surfactant]

Examples of the amphoteric surfactant include alkyl betaines (for example, products manufactured by Kao Corporation such as AMPHITOL 20BS, AMPHITOL 24B, AMPHITOL 86B, and AMPHITOL 20Y-B) and alkyl amine oxides (for example, products manufactured by Kao Corporation such as AMPHITOL 20N). In addition, other examples of the amphoteric surfactant include products manufactured by Sanyo Chemical Industries Ltd. such as LEBON 15, LEBON LAG-40, LEBON 50, LEBON S, and LEBON T-2; and products manufactured by NOF Corporation such as NISSAN ANON series). Examples of the fluorinated amphoteric surfactant include products manufactured by AGC Seimi Chemical Co., Ltd. such as SURFLON S-231, S-232, and S-233; products manufactured by 3M such as FLUORAD FX-172; and products manufactured by DIC Corporation such as MEGAFAC F-120.

[C. Addition Amount of Additive]

The amount of an additive which is used in ordinary electroplating is several hundred ppm to several thousand ppm. On the other hand, when the additive is added to the plating bath so as to be adsorbed to the separator 16 by impregnation ("direct method" described below), the amount of the additive required to obtain the excellent metal coating 28 is significantly less than that in ordinary electroplating. This point is also the same in a case where the additive is added to the separator 16 in advance.

In general, when the amount of the additive is excessively small, the excellent metal coating 28 cannot be obtained. On the other hand, even when the base material of the separator 16 is formed of a material that can selectively allow permeation of the metal ions, as the amount of the additive increases, the permeation of the metal ions through the separator 16 becomes more difficult. In addition, when the amount of the additive is excessively large, the metal ion permeability (ion conductivity) of the separator 16 significantly decreases. As a result, the bath voltage increases, and thus it is difficult to deposit the metal coating 28.

In order to obtain an excellent plating film without an increase in bath voltage, the content of the organic plating additive is preferably 0.004% to 10% with respect to the weight of the separator 16. In addition, when the separator 16 is the solid electrolyte membrane, and when the organic plating additive is the ionic compound, the content of the organic plating additive is preferably 0.1% to 50% with respect to an ion exchange capacity of the solid electrolyte membrane.

For example, a case where an ion exchange membrane having a thickness of 25 μm, a size of 30 mm×30 mm, and an ion exchange capacity of 1 mEq/g is in contact with a plating bath of 70 g is assumed. In this case, when the organic additive (molecular weight: approximately 300) is ionically bonded to an acid group of the membrane at 1:1, the amount of the additive, which is bonded (ion exchange) to 0.1% to 50% of the acid group of the membrane, is as follows: (1) 0.2 ppm to 90 ppm in terms of weight ratio with respect to the weight of the plating bath of 70 g; and (2) 0.004 wt % to 2 wt % with respect to the weight of the membrane.

When the separator 16 to which organic additive is added is used, the amount of the organic additive used can be reduced as compared to the method of the related art. The reason is as follows.

(1) When electrodeposition is performed using the separator 16, the movement of the additive to the anode chamber 12 is inhibited, and the consumption thereof by oxidation decomposition is inhibited.

(2) When the additive is fixed to the separator 16, the additive gradually moves to the cathode chamber 14 during electrodeposition, and the necessary amount is replenished.

(3) When electrodeposition is performed using the separator 16, the amount of the cathode chamber solution 24 can be made to be zero or extremely small. Since the additive concentration on the deposited metal surface is increased, the necessary amount of the additive can be made to be extremely small.

[D. Method of Adding Organic Plating Additive]

A method of adding the organic plating additive will be described using the organic compound containing N as an example.

[D.1. First Method (Direct Method)]

In a first method (direct method), the additive is not directly added to the separator 16 but indirectly dissolved in the plating bath in a necessary amount so as to come into contact with the separator 16 and to be adsorbed thereon by impregnation. In particular, when the cation exchange membrane is used as the separator 16, the ion exchange capacity (anion) of the membrane is strongly bonded to a cation portion $N^+$ of the additive and is fixed.

For example, in the separator 16 having a sulfonic acid group $RSO_3^-$, a cation portion $R'N^+$ of the organic compound containing N is strongly bonded thereto as shown in formula (2).

$$RSO_3^- + R'N^+ \rightarrow RSO_3NR' \quad (2)$$

In this case, it is preferable to prepare a bath in which the additive is dissolved such that acid group loss of the cation exchange membrane by the additive does not exceed 50%. In addition, when electrodeposition is performed after heating the bath at 40° C. or higher for 10 minutes or longer such that the additive is sufficiently adsorbed to the inside of the separator 16 instead of being performed immediately after the preparation of the bath, the unnecessary consumption of the additive in the electrode can be inhibited.

In general, it is not preferable that an amphoteric or cationic surfactant be added to an electroplating bath in which an ion exchange membrane is used because the separator 16 is contaminated and the conductivity decreases. However, in the embodiment of the invention, the amount of the additive adsorbed to the separator 16 is extremely small to the extent that the bath voltage does not increase. Therefore, the problems such as membrane fouling and a significant decrease in electrodeposition efficiency do not occur. Accordingly, for example, even when a surfactant having low biodegradability is used, the cost of waste treatment can be reduced.

This "direct method" is simpler than the "ion exchange treatment method" described below but has a problem in that counter ions of the additive remain in the plating bath and a problem in that 100% of the additive added to the plating bath may not be adsorbed (impregnated and fixed) to the separator 16. From this point of view, methods of adding the additive to the membrane in advance described below are preferable rather than the above-described "direction method." Among these methods, the "ion exchange treatment method" is more preferable.

[D.2. Second Method (Method of Adding Additive to Separator in Advance)]

In a second method, the additive is added to the separator in advance. Broadly, examples of this method are classified into the following four Methods A to D.

[D.2.1. Method A (Ion Exchange Treatment Method)]

In Method A (ion exchange treatment method), when the additive is water-soluble, the additive is fixed to the separator 16 by ion exchange. For example, in a case where the separator 16 is the cation exchange membrane, when the separator 16 is brought into contact with a treatment solution in which a water-soluble organic additive is dissolved under the condition that pH is slightly acidic to strongly alkaline, substantially 100% of a cation portion of the water-soluble organic additive is fixed to the cation exchange membrane by ion exchange.

Specifically, the water-soluble organic additive is dissolved in pure water to prepare the treatment solution such that the content of the water-soluble organic additive is 0.1% to 50% with respect to the ion exchange capacity of the cation exchange membrane. Next, the cation exchange membrane and the treatment solution are brought into contact with each other using a method such as dipping or spray coating. In this case, when the temperature of the treatment solution is 40° C. to 80° C., most part of the organic additive is fixed to the cation exchange membrane within several hours. After the treatment using the treatment solution, optionally, it is preferable that the ion exchange membrane be washed with heated pure water to remove counter ions (anions) such as halogen.

Here, an especially advantageous effect of the ion exchange treatment method is that counter ions (anions) of the additive can be removed. In general, counter ions of the water-soluble additive are likely to be chloride ions, bromide ions, fluoride ions, and the like which are highly corrosive. However, according to the ion exchange treatment method, these unnecessary counter ions are removed and are not introduced into the plating bath. Accordingly, the corrosion of a device or a jig can be suppressed.

The additive mainly functions on the electrodeposited surface side. It is not necessary to bring both surfaces (all the surfaces) of the membrane into contact with the treatment solution, and only a single surface (electrodeposited surface side) of the membrane may be brought into contact with the treatment solution to add the additive thereto. In addition, in the above description, the separator 16 is the cation exchange membrane. However, even when the separator 16 is the anion exchange membrane, the same treatment as described above can be performed. When the anion exchange membrane and the treatment solution are brought into contact with each other, an anion portion of the organic additive exchanges ions with an anion exchange group of the separator 16 and is fixed to the separator 16.

[D.2.2. Method B (Organic Solvent Impregnation Method)]

In Method B (organic solvent impregnation method), when the additive is water-insoluble, the additive is dissolved in an organic solvent to prepare a treatment solution, and the separator 16 and the treatment solution are brought into contact with each other so as to fix the additive to the inside of the separator 16. In Method B, since the additive added to the inside of the separator 16 is water-insoluble, the plating solution is gradually discharged. Accordingly, adverse effects (a decrease in electrodeposition efficiency and a decrease in physical properties of a plated coating due to codeposition of the additive) caused by the excess amount of the additive in the plating solution can be reduced. In addition, when a solvent which can appropriately swell the separator 16 is used as the organic solvent, a large amount of the additive can be impregnated into the membrane.

In the "ion exchange treatment method" in which the cation exchange membrane is used, only a cation portion of the additive is bonded to an acid group of the cation exchange group is fixed, but it is difficult to fix an anion of the additive thereto. On the other hand, with Method B, an anion of the additive can be fixed.

For example, saccharin will be described as an example. Saccharin is a water-insoluble compound and functions as an anion. Accordingly, in ordinary electroplating, a saccharin Na salt having high solubility to water is commonly used. Here, even when an aqueous solution of the saccharin Na salt is brought into contact with the cation exchange membrane, only a $Na^+$ portion is fixed to the membrane, and an anion portion is substantially not fixed to the membrane. On the other hand, saccharin (other than Na salts) is soluble in a nonaqueous solvent such as alcohol or DMF with a high concentration. In addition, the cation exchange membrane is significantly swollen by the nonaqueous solvent. Accordingly, by dissolving saccharin in the nonaqueous solution to prepare a treatment solution, bringing the cation exchange membrane into contact with the treatment solution, and then removing the solvent, saccharin (additive) can be added to the membrane with a high concentration.

[D.2.3. Method C (Cast Membrane Formation Method)]

In Method C (cast membrane formation method), the additive is dissolved or dispersed in a solution in which the base material of the separator 16 is dissolved in an organic solvent, this solution is cast on a substrate surface, and the solvent is removed by drying. In Method C, as in the case of Method B, even the water-insoluble additive can be added to the membrane by appropriately selecting the organic solvent. As in the case of the first method, the addition amount of the additive is preferably 0.1% to 50% with respect to the ion exchange capacity of the membrane and is preferably 0.004% to 10% with respect to the weight of the membrane. In addition, after the membrane formation, it is preferable that the membrane be washed with warm water to remove unnecessary water-soluble components and an anion.

[D.2.4. Method D (Melt Extrusion Method)]

In Method D (melt extrusion method), when the base material of the separator 16 is formed of a meltable material (for example, an organic material), the base material of the separator 16 and the additive are heated and kneaded, and the kneaded matter is melt-extruded into a film. In Method D, even the water-insoluble additive can be added to the membrane. As in the case of the first method, the addition amount of the additive is preferably 0.1% to 50% with respect to the ion exchange capacity of the membrane and is preferably 0.004% to 10% with respect to the weight of the membrane. In addition, after the membrane formation, it is preferable that the membrane be washed with warm water to remove unnecessary water-soluble components and an anion.

Among the above-described methods, the ion exchange treatment method is the simple and most economical method. According to the ion exchange treatment method, the additive can be uniformly added to the separator 16, and particularly, a special treatment device is not necessary.

[1.7.3. Metal Ions]

In addition to the organic plating additive, the separator 16 may further contain ions of metal constituting the metal coating 28. Examples of a method of adding the metal ions to the separator 16 include (1) a method of preparing the separator 16 and impregnating the separator 16 with a solution containing the metal ions; and (2) a method of dissolving or dispersing the base material of the separator 16 and a compound containing the metal ions in a solvent, coating the base material surface with this solution, and removing the solvent. As the compound for adding the metal ions to the separator 16, a water-soluble metal compound is preferably used. In addition, as the solution for adding the metal ions to the separator 16, a solvent having the same composition as that of the anode chamber solution is preferably used. The details of the water-soluble metal compound and the anode chamber solution will be described below.

[1.7.4. Method of Forming Separator]

When the base material of the separator 16 is formed of an organic material, the separator 16 (or the base material of the separator 16) can be formed using a commonly-used thin film forming method. Examples of the thin film forming method include a dipping method, a spray coating method, a spinning coating method, and a roll coating method. In addition, in the embodiment of the invention, the cathode chamber 14 is not necessarily provided. In this case, the separator 16 may be formed directly on the surface of the cathode 26. When the anode 22 is a porous body or a pattern electrode as described below, the separator 16 can be formed on the surface of the anode 22.

When the separator 16 is formed using a dipping method, the dipping temperature is preferably 0° C. to 100° C. and more preferably 5° C. to 20° C. In addition, the dipping time is preferably 0.01 minutes to 100 minutes and more preferably 0.05 minutes to 10 minutes. After the formation, the separator 16 may be dried. The drying time is preferably 1 minute to 100 minutes and more preferably 5 minutes to 30 minutes. The thickness of the separator 16 is not particularly limited but is preferably 0.01 μm to 200 μm and more preferably 0.1 μm to 50 μm. In a case where a solution containing the metal ions is added to the separator 16 after the formation of the separator 16, when the solution is water or an alcohol, it is preferable that the separator 16 be dipped under a reduced pressure (for example, 0.01 atm to 1 atm) at 0° C. to 100° C. (preferably, 5° C. to 25° C.).

[1.8. Power Supply]

The power supply 25 is not particularly limited as long as a predetermined voltage can be applied between the anode 22 and the cathode 26.

[2. Method of Forming Metal Coating Using Electroplating Cell 10]

[2.1. Preparation of Anode Chamber Solution]

First, the anode chamber solution 20 containing the metal ions which are to be deposited on the cathode (plated object) 26 is prepared. In order to prepare the anode chamber solution 20, the water-soluble metal compound containing the metal ions to be deposited is dissolved in water. Optionally, the anode chamber solution 20 may further contain (1) a water-soluble organic solvent (for example, alcohols); (2) a pH adjuster (a base, for example, amines such as ethylene diamine; or acids such as hydrochloric acid); and (3) a buffer (for example, an organic acid).

[2.1.1. Water-Soluble Metal Compound]

In the embodiment of the invention, the metal to be deposited is not particularly limited, and the optimum ones according to the purpose can be selected. Examples of the metal to be deposited include titanium, zirconium, vanadium, niobium, tantalum, chromium, molybdenum, tungsten, manganese, iron, cobalt, rhodium, iridium, nickel, tin, palladium, platinum, copper, silver, zinc, cadmium, aluminum, gallium, indium, silicon, germanium, arsenic, antimony, bismuth, selenium, and tellurium.

Among these, as the metal to be deposited, silver, copper, gold, nickel, tin, platinum, or palladium is preferably used because it can be electrodeposited in an aqueous solution, and the specific resistance of a metal coating thereof is low. In addition, in the case of Ni, typically, during electroplating, hydrogen is likely to be produced from the surface of the cathode 26, and a hydroxide is likely to be formed. However, when the embodiment of the invention is applied to Ni plating, the hydrogen production and the hydroxide formation can be suppressed.

Examples of the water-soluble metal compound include (1) a halide such as a chloride; (2) an inorganic acid salt such as a sulfate (for example, copper sulfate or nickel sulfate) or a nitrate (for example, silver nitrate); and (3) an organic acid salt such as an acetate. From the viewpoint of the material cost, an inorganic acid salt is preferably used. The anode chamber solution 20 may contain one water-soluble metal compound alone or a combination of two or more water-soluble metal compounds.

The concentration of the water-soluble metal compound contained in the anode chamber solution 20 is not particularly limited, and the optimum value for the kind or the like of the water-soluble metal compound is selected. For example, in a case where the metal ions are nickel ions, when the nickel ion concentration is excessively low, hydrogen production mainly occurs in the electrodeposition reaction, and the electrodeposition efficiency decreases. Accordingly, the nickel ion concentration is preferably 0.001 M/L or higher. On the other hand, when the nickel ion concentration is excessively high, nickel hydroxide is likely to be precipitated. Accordingly, the nickel ion concentration is preferably 2.0 M/L or lower.

[2.1.2. pH Adjuster]

A pH adjuster is optionally added to the anode chamber solution 20. The pH of the anode chamber solution 20 is not particularly limited, and the optimum value for the kind or the like of the water-soluble metal compound is selected. For example, in a case where the metal ions are nickel ions, when the pH is excessively low, hydrogen production mainly occurs in the electrodeposition reaction, and the electrodeposition efficiency decreases. Accordingly, the pH is preferably 1 or higher. On the other hand, when the pH is excessively high, nickel hydroxide is likely to be precipitated. Accordingly, the pH is preferably 7 or lower.

[2.1.3. Buffer]

A buffer is optionally added to the anode chamber solution 20. Examples of the buffer include an organic acid. When plating is performed using the anode chamber solution 20 not containing an organic acid and the insoluble electrode (anode 22), the pH of the anode chamber solution 20 significantly decreases due to oxygen production on the anode 22, and the electrodeposition efficiency is likely to decrease. This phenomenon can be easily understood when it is assumed that ionic equilibrium between the anode chamber solution 20 and the inside of the separator 16 is achieved.

For example, in the case of electrodeposition from $Ni^{2+}$ ions, when pH decreases in the anode chamber 12, and $H^+$ is rich, the $H^+$ concentration increases and the $Ni^{2+}$ concentration decreases in the separator 16. Therefore, it is considered that the $Ni^{2+}$ ion transport number decreases in the separator 16 during the electrodeposition, and the limiting current density $I_L$ obtained by equation (1) decreases. In general, when the separator 16 is present, the separator 16 functions as a barrier of $H^+$ movement. Therefore, a pH decrease of the cathode chamber solution 24 is suppressed as compared to a case where the separator 16 is not present. In this case, when an organic acid is added, the organic acid (weak acid) functions as a buffer for suppressing a pH decrease. Accordingly, when the separator 16 and the organic acid are used in combination, the electrodeposition efficiency can be further improved. In addition, the addition of an appropriate amount of the organic acid is also preferable from the viewpoint of preventing the formation of nickel hydroxide.

Examples of the organic acid include (1) a saturated carboxylic acid such as formic acid, acetic acid, or propionic acid; (2) a ketonecarboxylic acid such as pyruvic acid; (3) a hydroxycarboxylic acid such as glycolic acid, lactic acid, citric acid, malic acid, or tartaric acid; (4) a sulfonic acid such as methanesulfonic acid or ethanesulfonic acid; (5) an aminocarboxylic acid such as glycine, alanine, glutamic acid, or aspartic acid; (6) an aminosulfonic acid such as taurine; and (7) an aromatic carboxylic acid such as benzoic acid. From the viewpoints of low toxicity and easiness (environmental load and odor) of waste liquid treatment, acetic acid, glycolic acid, or citric acid is preferably used as the organic acid. In particular, glycolic acid is more preferably used because it can improve the electrodeposition efficiency and has no odor.

When the concentration of the organic acid in the anode chamber solution 20 is excessively low, the pH buffering effect is low, and the pH is likely to vary. Accordingly, the concentration of the organic acid in the anode chamber solution 20 is preferably 0.01 M/L or higher. On the other hand, when the concentration of the organic acid is excessively high, the waste liquid treatment cost increases, which is not economical. Accordingly, the concentration of the organic acid in the anode chamber solution 20 is preferably 1 M/L or lower. In addition, a molar ratio (organic acid/metal ions) of the organic acid concentration to the metal ion concentration is preferably 0.1 to 10. In addition to the organic acid, a base (pH adjuster) such as ammonia, NaOH, or KOH may be added to the plating bath in an appropriate amount to adjust the pH.

[2.1.4. Amount of Anode Chamber Solution]

The amount of the anode chamber solution 20 is not particularly limited, and the optimum amount according to the purpose can be selected.

[2.2. Preparation of Cathode Chamber Solution]

[2.2.1. Composition of Cathode Chamber Solution]

Next, the cathode chamber solution 24 is prepared. Since the composition of the cathode chamber solution 24 is the same as that of the anode chamber solution 20, the description thereof will not be repeated.

[2.2.2. Amount of Cathode Chamber Solution]

The amount of the cathode chamber solution 24 is not particularly limited, and the optimum amount according to the purpose can be selected. In the embodiment of the invention, the amount of the cathode chamber solution 24 may be small. Specifically, the amount of the cathode chamber solution 24 may be 100 $\mu L/cm^2$ or less per unit area of the cathode 26. In addition, the cathode chamber 14 and the cathode chamber solution 24 are not necessarily provided, that is, the separator 16 and the cathode 26 may be in close contact with each other.

When the cathode chamber solution 24 is not substantially present, an extremely small amount of water is transported from the separator 16 to the electrodeposited surface (surface of the cathode 26) by electroendosmosis. Therefore, a continuous interface is formed between the separator 16 and the cathode 26, and an electrochemical reaction (electrodeposition) can be performed. In order to improve the adhesion between the separator 16 and the surface of the cathode 26, optionally, it is preferable that electrodeposition be performed in a state where both the separator 16 and the surface of the cathode 26 are pressurized using a pressurization mechanism.

A method of electrodepositing metal in an aqueous solution with high speed using an electroplating cell is not known, in which the cathode chamber solution 24 is not substantially present and the separator 16 is used in the electroplating cell; and hydrogen production is likely to occur in the metal. When the metal is electrodeposited in a state where the cathode chamber solution 24 is not substantially present, the shape of the anode 22 can be transferred to the plated object, and a metal pattern can be formed without masking. In addition, since the cathode chamber solution 24 is not present, the adhesion or extraction of the plating solution to the plated object can be removed, and the washing step and the waste liquid treatment step after electrodeposition can be significantly simplified.

[2.3. Electrodeposition]

The anode chamber solution 20 and cathode chamber solution 24 are added to the anode chamber 12 and the cathode chamber 14 in predetermined amounts, respectively. Next, using the power supply 25, a voltage is applied between the anode 22 and the cathode 26 with the separator 16 interposed between the anode 22 and the cathode 26. As a result, the metal ions in the cathode chamber solution 24 are reduced, and the metal coating 28 is deposited on the cathode 26. When the deposition of the metal coating 28 progresses, the metal ion concentration of the cathode chamber solution 24 decreases. As a result, a metal ion concentration gradient is generated between the cathode chamber solution 24 and the anode chamber solution 20. By this concentration gradient functioning as a driving force, the metal ions in the anode chamber solution 20 are diffused to the cathode chamber solution 24 through the separator 16. At the same time, the additive in the separator 16 is also replenished in the cathode chamber solution 24.

The voltage applied between the electrodes, the temperature of the plating bath during electrodeposition, and the electrodeposition time are not particularly limited, and the optimum values according to the purpose can be selected. For example, in the case of nickel plating, the voltage is preferably 0.01 V to 100 V and more preferably 0.05 V to 10 V. The temperature of the plating bath is preferably 0° C. to 100° C. and more preferably 10° C. to 25° C. Further, the electrodeposition time is preferably 0.01 minutes to 100 minutes and more preferably 0.05 minutes to 5 minutes.

[3. Electroplating Cell 40]

An electroplating cell according to a second embodiment of the invention includes: an anode chamber in which an anode chamber solution is stored; and a separator that separates the anode chamber and a cathode from each other. In addition, an organic plating additive is added to a base material of the separator, and the separator can selectively allow permeation of metal ions contained in the anode chamber solution. That is, the electroplating cell according to the embodiment does not include a cathode chamber in which a cathode chamber solution is stored. From this point of view, the second embodiment is different from the first embodiment.

Figure 2A:
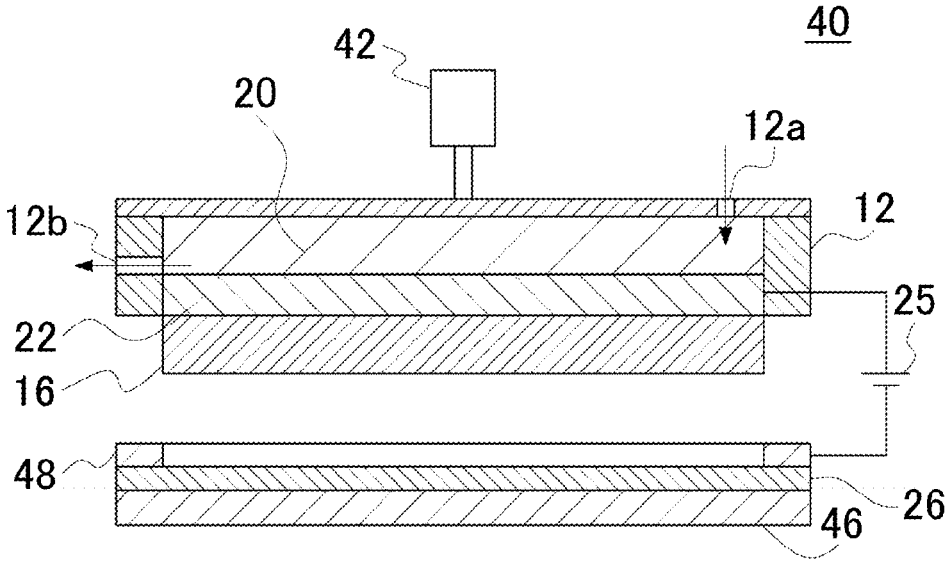
FIGS. 2A and 2B are schematic diagrams illustrating an electroplating cell according to a second embodiment of the invention.
Figure 2B:
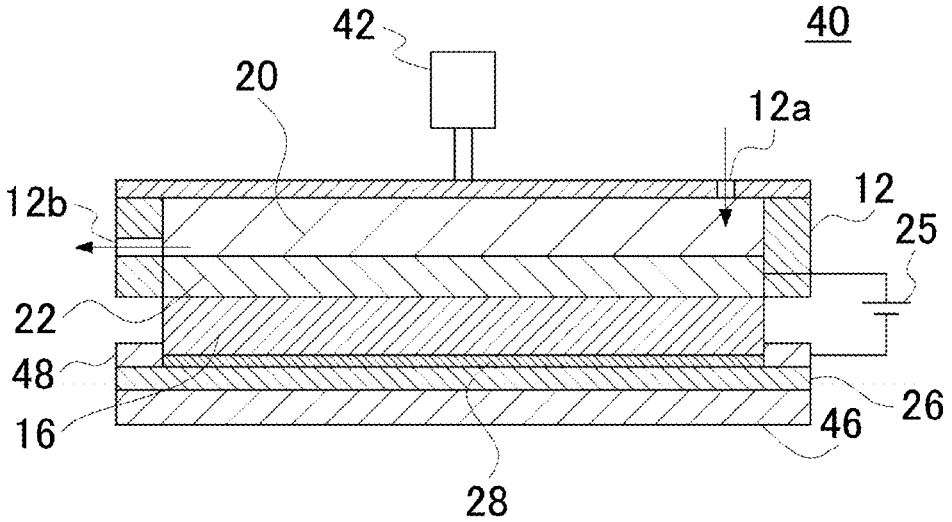

FIGS. 2A and 2B are schematic diagrams illustrating the electroplating cell according to the second embodiment of the invention. In FIGS. 2A and 2B, the electroplating cell 40 includes the anode chamber 12, separator 16, the anode 22, the cathode 26, the power supply 25, and a pressurizing device 42.

In the anode chamber 12, the anode chamber solution 20 is stored. A supply hole 12*a* is provided on an upper portion of the anode chamber 12 to supply the anode chamber solution 20 from an anode chamber solution tank (not illustrated) to the inside of the anode chamber 12. In addition, a discharge hole 12*b* is provided on a side surface of the anode chamber 12 to discharge the anode chamber solution 20 from the anode chamber 12 to a waste liquid tank (not illustrated). The anode 22 is fitted to an opening of a lower end of the anode chamber 12. Further, the separator 16 is bonded to a lower surface of the anode 22. The pressurizing device 42 is provided on an upper surface of the anode chamber 12. The pressurizing device 42 is provided to move the anode chamber 12, the anode 22, and the separator 16 in the vertical direction.

A base 46 is disposed below the anode chamber 12. The cathode (plated object) 26 is disposed on an upper surface of the base 46. A current carrying portion 48 is provided on an outer periphery of an upper surface of the cathode 26. The current carrying portion 48 is provided to apply a voltage to the cathode 26 and surrounds a membrane-forming region of the surface of the cathode 26. As illustrated in FIGS. 2A and 2B, the current carrying portion 48 has a ring shape, and a tip end portion of the separator 16 can be inserted to this ring shape. Further, the anode 22 and the current carrying portion 48 (that is, the cathode 26) is connected to the power supply 25.

In the embodiment, as the anode 22, an electrode that can allow the supply of the anode chamber solution 20 to the surface of the separator 16 is used. Specific examples of the anode 22 include a porous electrode having a pore size and a pattern electrode having a predetermined shape pattern that can selectively allow permeation of the anode chamber solution 20. When the metal coating 28 is not continuously formed, a gap present inside the anode 22 can be used as the anode chamber, that is, the anode 22 can be impregnated with a necessary amount of the anode chamber solution, and the anode chamber 12 may not be substantially provided. Since the other points regarding the anode chamber 12, the separator 16, the anode 22, the cathode 26, and the power supply 25 are the same as those of the first embodiment, the description thereof will not be repeated.

[4. Method of Forming Metal Coating Using Electroplating Cell 40]

First, as illustrated in FIG. 2A, in a state where the base 46 and the separator 16 are separated from each other, the cathode 26 is disposed on the base 46, and the current carrying portion 48 is disposed around the cathode 26. In addition, the anode chamber solution 20 is supplied into the anode chamber 12 through the supply hole 12*a*. The anode chamber solution 20 is supplied to the surface of the separator 16 through a gap (not illustrated) inside the anode 22. Next, as illustrated in FIG. 2B, the anode chamber 12 is moved down using the pressurizing device 42, and a lower surface of the separator 16 is brought into contact with the upper surface of the cathode 26. At this time, a pressure force of the pressurizing device 42 is adjusted such that an appropriate pressure is applied to an interface between the separator 16 and the cathode 26.

In this state, when a predetermined voltage is applied to the anode 22 and the current carrying portion 48 (that is, the cathode 26) using the power supply 25, the metal coating 28 is deposited on the interface between the separator 16 and the cathode 26. At this time, optionally, when the new anode chamber solution 20 is supplied to the inside of the anode chamber 12 through the supply hole 12*a* while discharging the consumed anode chamber solution 20 out from the discharge hole 12*b*, continuous plating can be performed. After a predetermined time, the anode chamber 12 is moved up using the pressurizing device 42 such that the separator 16 and the cathode 26 are separated from each other.

[5. Metal Coating]

The metal coating according to the embodiment of the invention is obtained using the method according to the embodiment of the invention. When electroplating is performed using a method of the related art, the obtained metal coating may contain a streak defect or may be insufficient in smoothness. Further, when plating is performed in a state where a separator and a cathode are in contact with each other, the metal coating may infiltrate into the separator. On the other hand, when electroplating is performed using the separator to which the organic plating additive is added, a metal coating which has no streak defect and is excellent in smoothness can be obtained. The reason is considered to be that the decomposition of the additive is suppressed by adding the additive to the separator. Further, even when plating is performed in a state where a separator and a cathode are in contact with each other, the metal coating does not infiltrate into the separator.

[6. Effects]

When the organic plating additive for modifying the properties of the metal coating is added to the anode chamber solution, a relatively large amount of the additive is necessary. The addition of a large amount of the additive to the anode chamber solution causes a decrease in electrodeposition efficiency by the decomposition and consumption of the additive, or makes the concentration control complicated. On the other hand, when the organic plating additive is added to the separator, the additive is gradually moved from the separator to the cathode chamber solution, and a necessary amount thereof is replenished. Therefore, an excellent metal coating can be easily obtained. In addition, when electrodeposition is performed using the separator, the amount of the cathode chamber solution can be made to be zero or extremely small. Therefore, even when the addition amount of the additive to the separator is extremely small, the additive concentration on the cathode side is relatively high, and the properties of the coating are improved. Further, since only a minimum amount of the additive is fixed to the separator, the bath voltage does not increase.

The concentration control of the organic plating additive and the removal of a waste product derived from the additive are significant issues even in ordinary electroplating. On the other hand, in the method according to the embodiment of the invention, only a small amount of the additive is added to the separator. Therefore, electrodeposition can be performed without controlling the concentration of the plating solution. In addition, the removal of a waste product derived by the oxidation and reduction of the additive is substantially unnecessary, and thus the separator can be repeatedly used. Further, when the consumption of the additive in the separator is severe, the addition amount of the additive to the separator can be adjusted, or the additive can be periodically added again to the separator in consideration of the amount of supplied electric power.

Examples 1 and 2 and Comparative Examples 1 to 4

1. Preparation of Metal Coating

1.1. Examples 1 and 2

The metal coating 28 was prepared using the electroplating cell 10 illustrated in FIG. 1. As the base material of the separator 16, a perfluorosulfonic acid-based cation exchange membrane (thickness: 183 μm, size: 30 mm×30 mm) was used. As the solution for fixing the additive to the separator 16, 100 mL of an aqueous solution in which hexadecyltrimethylammonium bromide or tetramethylammonium hydroxide is dissolved in ultrapure water was prepared. The additive concentration in the solution was controlled to be 20% to 100% with respect to the ion exchange capacity of the cation exchange membrane. For ion exchange of the membrane, a dipping treatment was performed using a covered PFA container at 80° C. for 2 hours. In addition, after the ion exchange, the separator 16 was washed with warm water at 80° C. for 2 hours and was held in ultrapure water.

As the anode 22 and the cathode 26 (sample electrode), a Pt plate having a size of 2 cm×2 cm and a thickness of 300 m was used. As the plating solution, a solution containing 1 M/L of $NiSO_4$ and 0.5 M/L of $CH_3COOH$ was used, and the pH thereof was adjusted to 0.5 using a 20 wt % NaOH solution. 35 g of this solution was added to each of the anode chamber 12 and the cathode chamber 14, and 70 g of the plating bath in total was prepared.

The separator 16 is interposed in a two-chamber vinyl chloride cell having an opening area of 20 mm×20 mm. While stirring the anode chamber solution 20 and the cathode chamber solution 24 with a magnetic stirrer, respectively, constant-current electrodeposition was performed using the power supply 25 (a DC constant current power supply having upper limit voltage: 70 V) under conditions of room temperature, 100 mA/cm$^2$, and 60 minutes.

1.2. Comparative Examples 1 to 4

For comparison, (1) electrodeposition was performed without using the separator 16 (Comparative Example 1); (2) electrodeposition was performed using the separator 16 containing no additive (Comparative Example 2); (3) electrodeposition was performed using the separator 16 containing no additive and using the plating bath containing no acetic acid (Comparative Example 3); and (4) electrodeposition was performed using the separator 16 to which the additive is added in an amount corresponding to 100% of the ion exchange capacity (Comparative Example 4).

2. Test Method

2.1. Electrodeposition Efficiency

The electrodeposition efficiency (%) was calculated from a weight change of the sample before and after the electrodeposition and a theoretical weight increase obtained from Faraday's law.

2.2. Appearance

The appearance of the coating was determined by visual inspection.

2.3. pH

After the electrodeposition, the pH of each of the anode chamber solution 20 and the cathode chamber solution 24 was measured using a pH meter (manufactured by Horiba Ltd.)

3. Result

The results are shown in Table 1.

TABLE 1

| | Additive | Membrane | Addition Amount (in Terms of Acid Group of Membrane) | Electrode position Efficiency (%) | Cathode Chamber pH | Anode Chamber pH | Deposited Ni Properties |
|---|---|---|---|---|---|---|---|
| Example 1 | Hexadecyl Trimethyl ammonium Bromide | Present | 20 | 96.1 | 5.19 | 2.92 | Bright (Smooth) |
| Example 2 | Tetramethyl ammonium Hydroxide | Present | 50 | 96.4 | 5.19 | 2.92 | Bright (Smooth) |
| Comparative Example 1 | None | None | 0 | 91.1 | 4.12 | 4.12 | Semi-Bright (Smooth) |

TABLE 1-continued

| | Additive | Membrane | Addition Amount (in Terms of Acid Group of Membrane) | Electrode position Efficiency (%) | Cathode Chamber pH | Anode Chamber pH | Deposited Ni Properties |
|---|---|---|---|---|---|---|---|
| Comparative Example 2 | None | Present | 0 | 95.8 | 5.10 | 2.90 | Semi-Bright (Smooth) |
| Comparative Example 3 | None (Acetic Acid Not Added) | Present | 0 | 74.5 | 6.89 | 1.20 | Burnt deposit (Grainy) |
| Comparative Example 4 | Hexadecyl Trimethyl Ammonium Bromide | Present | 100 | Current Not Flowable at Bath Voltage of 70 V or Higher | | | |

In Examples 1 and 2 in which an appropriate amount of the additive was added to the separator 16, the electrodeposition efficiency was improved, and the brightness (smoothness) of a NI coating was enhanced, as compared to Comparative Example 1 in which the separator 16 is not used or Comparative Example 2 in which the separator 16 to which the additive was not added was used. The reason why the electrodeposition efficiency of Examples 1 and 2 was improved is considered to be as follows. Due to the presence of the separator 16, the infiltration of $H^+$ produced in the anode 22 to the cathode chamber 14 is difficult, and the pH of the cathode chamber solution 24 did not decrease compared to the initial value (pH=5).

In Comparative Example 3 in which the plating bath to which acetic acid was not added was used, the electrodeposition efficiency was low, and the pH of the anode chamber solution 20 and the cathode chamber solution 24 significantly changed. In addition, as a result of the visual inspection, when the deposited coating was in the form of powder or a lump, the formation of green nickel hydroxide was observed. In Comparative Example 4 in which the content of the additive (brightening agent) was excessively high, the conductivity of the separator 16 decreased. Therefore, the bath voltage was higher than the upper limit of the power supply device, and electrodeposition was not able to be performed.

Examples 3 to 5 and Comparative Examples 5 and 6

1. Preparation of Metal Coating

1.1. Examples 3 to 5

Using the same electroplating cell as that of Example 1, a Ni coating was formed. However, as the plating solution, 0.5 M/L of glycolic acid (pH was adjusted to 3) was added instead of acetic acid. Electrodeposition conditions were temperature: room temperature, current density: 200 mA/cm$^2$, time: 30 minutes, and whether to perform stirring: not stirred.

As the separator 16, the same perfluorosulfonic acid-based cation exchange membrane as that of Example 1, a natural cellulose membrane (thickness: 30 μm; manufactured by Nippon Kodoshi Corporation), and a cellulose phosphate membrane (thickness: 230 μm; 3698-875 manufactured by Watt Mann Co., Ltd.) were used. As the organic additive, saccharin (other than Na salts) was used.

The separator 16 was dipped for 5 minutes in a solution in which 0.4 g of saccharin was dissolved in 10 g of dimethylformamide (DMF). Next, the separator 16 was pulled up, and the surplus DMF was absorbed by a filter paper, followed by vacuum drying at 80° C. for 2 hours. The weight ratio of saccharin, which was fixed to the separator 16, to the separator 16 was 6.3 wt % (Example 3: 20 mg) in the perfluorosulfonic acid-based cation exchange membrane, was 3.9 wt % (Example 4: 0.5 mg) in the cellulose membrane, and was 2.2 wt % (Example 5: 1.7 mg) in the cellulose phosphate membrane.

1.2. Comparative Examples 5 and 6

Electrodeposition was performed in which the perfluorosulfonic acid-based cation exchange membrane was used as the separator 16, and saccharin was added to only the cathode chamber solution 24 in the same amount (20 mg) as that of Example 3 (Comparative Example 5). In addition, electrodeposition was performed without using the separator 16 and the additive (Comparative Example 6).

2. Test Method and Result

The electrodeposition efficiency and the appearance of the coating were evaluated using the same methods as those of Example 1. The results are shown in Table 2.

TABLE 2

| | Membrane | Additive | Electrodeposition Efficiency (%) | Brightness |
|---|---|---|---|---|
| Example 3 | Perfluorosulfonic Acid | Saccharin | 92.7 | Bright |
| Example 4 | Cellulose | Saccharin | 91.8 | Bright |
| Example 5 | Cellulose Phosphate | Saccharin | 93.6 | Bright |
| Comparative Example 5 | Perfluorosulfonic Acid | Saccharin (Cathode Chamber) | 90.4 | Bright |
| Comparative Example 6 | None | None | 82.2 | Dull |

The electrodeposition efficiency was 92.7% in Example 3, was 91.8% in Example 4, and was 93.6% in Example 5. In addition, all the Ni coatings obtained in Examples 3 to 5 were smooth and bright. On the other hand, the Ni coating obtained in Comparative Example 5 was bright, but the electrodeposition efficiency thereof was 90.4%. In addition, the Ni coating obtained in Comparative Example 6 was dull and grainy, and the electrodeposition efficiency thereof was 82.2%.

Examples 6 to 13 and Comparative Example 7

1. Preparation of Metal Coating 1.1. Examples 6 to 13

The same separator 16 as that of Example 1 was subjected to the ion exchange treatment. The addition amount of various additives was 10% with respect to an acid group of the membrane. As the plating solution, a solution containing 1 M/L of $NiSO_4$ and 0.5 M/L of $CH_3COOH$ was used, and the pH thereof was adjusted to 5 using $CH_3COONa$ and a NaOH solution. A Pt—Ti porous body (anode) impregnated with the plating solution, the additive-containing separator, the base material (Au-plated Al plate; cathode) were laminated in this order, and the laminate was pressurized under 0.5 MPa. The amount of the cathode chamber solution was zero. In this state, constant-current electrodeposition was performed. The current density was 5 mA/cm$^2$ to 50 mA/cm$^2$, and the electrodeposition time was 10 minutes.

1.2 Comparative Example 7

Electrodeposition was performed using the same method as that of Example 6, except that the separator 16 to which the additive was not added was used (Comparative Example 7).

2. Test Method and Result

The appearance of the obtained metal coating was evaluated. In addition, the metal coating was subjected to TOF-SIMS analysis, SEM observation, and EMPA analysis. Table 3 shows the electrodeposition results at current density: 10 mA/cm$^2$ and electrodeposition time: 10 minutes.

TABLE 3

| | Additive | Kind of Additive | Infiltration Between Membrane and Base Material |
|---|---|---|---|
| Example 6 | Hexadecylammonium bromide | Quaternary Ammonium Compound | None |
| Example 7 | Tetramethylammonium hydroxide | Quaternary Ammonium Compound | None |
| Example 8 | Tetrapropylammonium hydroxide | Quaternary Ammonium Compound | None |
| Example 9 | Anhydrous betaine | Quaternary Ammonium Compound | None |
| Example 10 | Tributylmethylphosphonium carbonate | Phosphonium Compound | None |
| Example 11 | Tetraphenylphosphonium bromide | Phosphonium Compound | None |
| Example 12 | Hexamethylenetetramine | Amine | None |
| Example 13 | Fluorinated surfactant S-221 | Cationic Surfactant | None |
| Comparative Example 7 | None | — | Occurred |

In all the Examples 6 to 13 in which the separator 16 to which the additive was added was used, the infiltration did not occur between the separator 16 and the base material, and a smooth Ni coating was obtained. Further, regarding the separator 16 of Example 6, electrodeposition was performed at an increased current density of 50 mA/cm$^2$, the infiltration did not occur between the separator 16 and the base material. On the other hand, in Comparative Example 7 in which the non-treated separator was used, the infiltration occurred between the deposited Ni and the cation exchange membrane even at a current density of 5 mA/cm$^2$.

When the separator 16 of Example 6 was analyzed by TOF-SIMS, the presence of an N-containing component in the separator 16 was found. In addition, there was no change in detection density before and after the electrodeposition, and thus it was found that most part of the organic additive remained in the separator 16 after the completion of the electrodeposition. In addition, when a P component (Example 11) was analyzed by EMPA, there was no change in P density change before and after the electrodeposition, and thus it was found that most part of the organic additive remained in the separator 16 after the completion of the electrodeposition.

Figure 3:
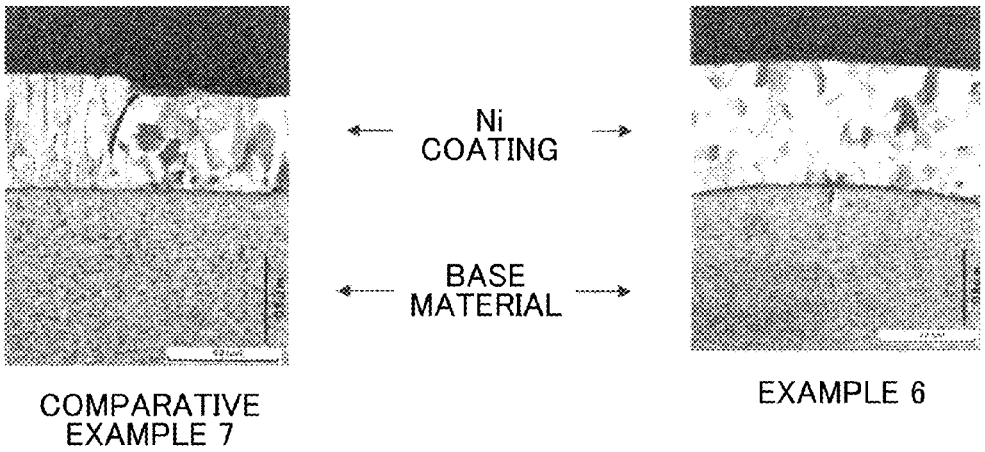
FIG. 3 shows SEM images of cross-sections of metal coatings obtained in Example 6 (right image) and Comparative Example 7 (left image).

FIG. 3 shows SEM images of cross-sections of metal coatings (Ni coatings) obtained in Example 6 (right image) and Comparative Example 7 (left image). A state where crystal was refined due to the effect of the additive added to the separator 16 was identified, and it was found that the formation of a coating defect was suppressed.

Hereinabove, the embodiments of the invention have been described in detail, but the invention is not limited to the above-described embodiments.

The electroplating cell according to the embodiment of the invention can be used for the formation of various metal coatings.

What is claimed is:

1. An electroplating cell comprising:

an anode chamber in which an anode chamber solution is stored; and a separator that includes a base material and an organic plating additive contained in the base material, separates the anode chamber and a cathode from each other, and selectively allows permeation of metal ions contained in the anode chamber solution;

wherein the base material of the separator is formed of a solid electrolyte membrane;

the organic plating additive is formed of an ionic compound;

a content of the organic plating additive is 0.1% to 50% with respect to an ion exchange capacity of the solid electrolyte membrane;

the organic plating additive is added to the separator by an ion exchange treatment; and the anode chamber does not include the organic plating additive contained in the solid electrolyte membrane.

2. The electroplating cell according to claim 1, further comprising:

a cathode chamber in which a cathode chamber solution is stored, wherein the separator is provided at a boundary between the anode chamber and the cathode chamber.

3. The electroplating cell according to claim 2, wherein the separator is configured such that the organic plating additive will elute to the cathode chamber solution.

4. The electroplating cell according to claim 1, wherein the organic plating additive contains one or more additives selected from the group consisting of a primary brightening agent, a secondary brightening agent, a surfactant, and a complexing agent.

5. The electroplating cell according to claim 1, wherein the organic plating additive contains an organic compound containing N or P.

6. The electroplating cell according to claim 1, wherein the base material of the separator is formed of a cation exchange membrane, and the organic plating additive contains a cationic surfactant or an amphoteric surfactant.

7. The electroplating cell according to claim 1, wherein the organic plating additive contains one or more compounds selected from the group consisting of a quaternary ammonium compound, an imidazolium compound, an aminocarboxylic acid compound, an amide compound, and a phosphonium compound.

8. The electroplating cell according to claim 1, wherein a content of the organic plating additive is 0.004% to 10% with respect to a weight of the separator.

9. A method of forming a metal coating comprising:

forming the metal coating on a surface of the cathode using the electroplating cell according to claim 1.

* * * * *